United States Patent [19]

Fung

[11] 3,956,864

[45] May 18, 1976

[54] COMPOSITE STRUCTURAL ASSEMBLY

[75] Inventor: Ching Fung, Willowdale, Canada

[73] Assignee: Westeel-Rosco Limited, Toronto, Canada

[22] Filed: Feb. 24, 1975

[21] Appl. No.: 552,566

[30] Foreign Application Priority Data

Dec. 30, 1974 Canada ..... 217139

[52] U.S. Cl. ..... 52/414; 52/335; 52/448; 52/450; 52/588

[51] Int. Cl.[2] ..... E04B 1/18

[58] Field of Search ..... 5/319–327, 5/329, 335–339, 414, 447, 448, 450; 52/588

[56] References Cited

UNITED STATES PATENTS

| | | | |
|---|---|---|---|
| 2,064,910 | 12/1936 | Harper | 52/335 |
| 3,608,267 | 9/1971 | Curran | 52/335 X |

*Primary Examiner*—Frank L. Abbott
*Assistant Examiner*—Carl D. Friedman

[57] ABSTRACT

In order to provide, in a composite structural assembly comprising a plurality of metallic support members disposed in side-by-side relationship and a layer of cementitious material disposed on the plurality of support members, for the securement of the support members to the layer of cementitious material in a particularly simple and efficient manner, there are provided spaced lugs which project from each side edge portion of each of the support members, with according to one aspect of the invention the lugs presented by adjacent side edge portions of adjacent support members being interfitted and being embedded within the layer of cementitious material. According to an alternative aspect of the invention the spaces between the lugs presented by each of said side edge portions are each in alignment with respective ones of the spaces between the lugs presented by the other of said side edge portions, reinforcement rods being disposed through said spaces, with the lugs and the reinforcement rods being embedded within the layer of cementitious material.

12 Claims, 6 Drawing Figures

COMPOSITE STRUCTURAL ASSEMBLY

This invention is concerned with a composite structural assembly of the type comprising support means on which a layer of cementitious material is disposed, with the support means being secured to the layer of cementitious material. In a composite structural assembly of this type the layer of cementitious material which is usually concrete provides at least the major proportion of the required compressive strength of the assembly, while the support means which is usually of a metallic material such as steel provides at least the major proportion of the required tensile strength of the assembly, it being well known that concrete is extremely weak in tension.

Composite structural assemblies of the type hereinbefore described are of course already known, reference in this connection being directed to, for example, U.S. Pat. Nos. 865,477 which issued on Sept. 10, 1907, to H. F. Cobb and 2,574,667 which issued on Nov. 13, 1951, to E. C. Shuman. While the forms of composite structural assemblies disclosed in these prior United States patents will no doubt function reasonably satisfactorily, it is a primary object of the present invention to provide composite structural assemblies of the type hereinbefore described in which the securement between the support means and the layer of cementitious material is improved in a simple and efficient manner resulting in composite structural assemblies which are relatively inexpensive to produce.

According to one aspect of the present invention there is provided a composite structural assembly which comprises a plurality of support members disposed in side-by-side relationship, and a layer of cementitious material disposed on the plurality of support members. The plurality of support members have side edge portions each of which presents spaced, projecting lugs, with the lugs presented by one of adjacent side edge portions of adjacent support members alternating in interfitted relationship with the lugs presented by the other of said adjacent side edge portions of said adjacent support members, and with the lugs being embedded within the layer of cementitious material.

According to an alternative aspect of the present invention there is provided a composite structural assembly which comprises a plurality of support members disposed in side-by-side relationship, and a layer of cementitious material disposed on the plurality of support members. The plurality of support members have side edge portions each of which presents spaced, projecting lugs, the lugs presented by the opposed side edge portions of each support member being convergent in the direction from said member towards the face of the layer of cementitious material remote from said member, whereby adjacent lugs presented by adjacent side edge portions of adjacent support members are inclined at an angle relative to one another. The spaces between the lugs presented by each of said side edge portions are each in alignment with respective ones of the spaces between the lugs presented by the other of said side edge portions, reinforcement rods being disposed through said spaces, with the lugs and the reinforcement rods being embedded within the layer of cementitious material.

In order that the invention may be more clearly understood and more readily carried into effect the same will now, by way of example, be more fully described with reference to the accompanying drawings in which.

Figure 1:
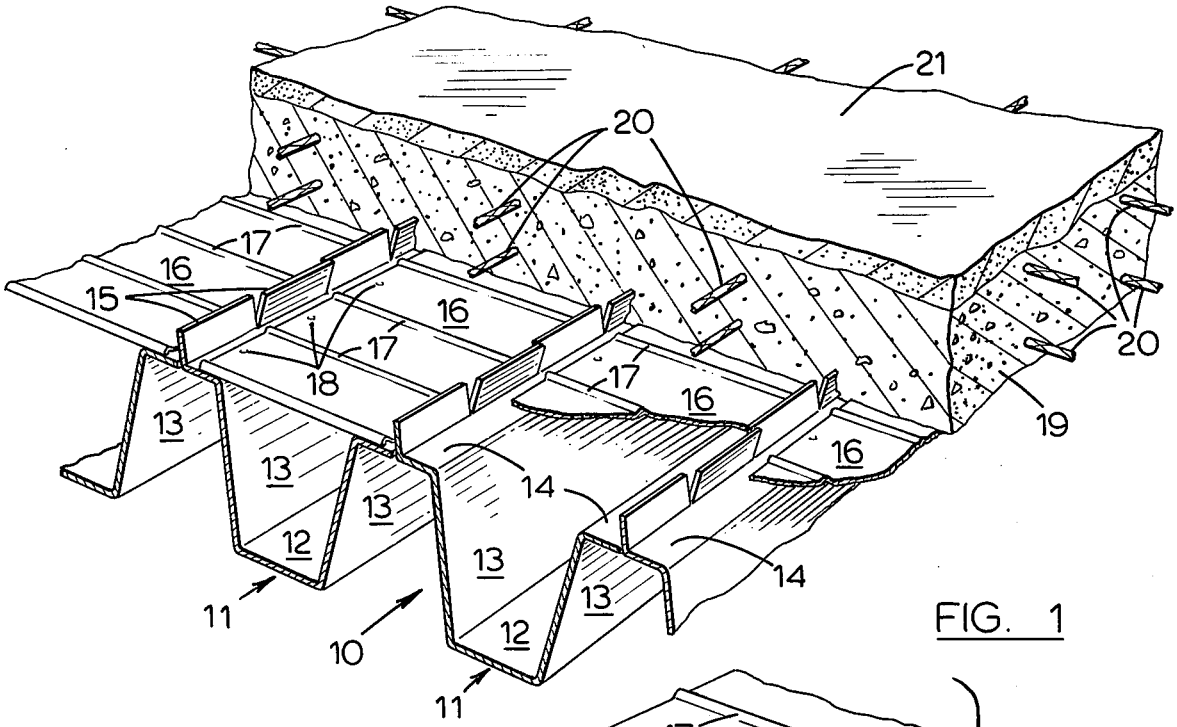
FIG. 1 is a perspective, partially broken-away view of a composite structural assembly according to a preferred embodiment of the invention.
Figure 2:
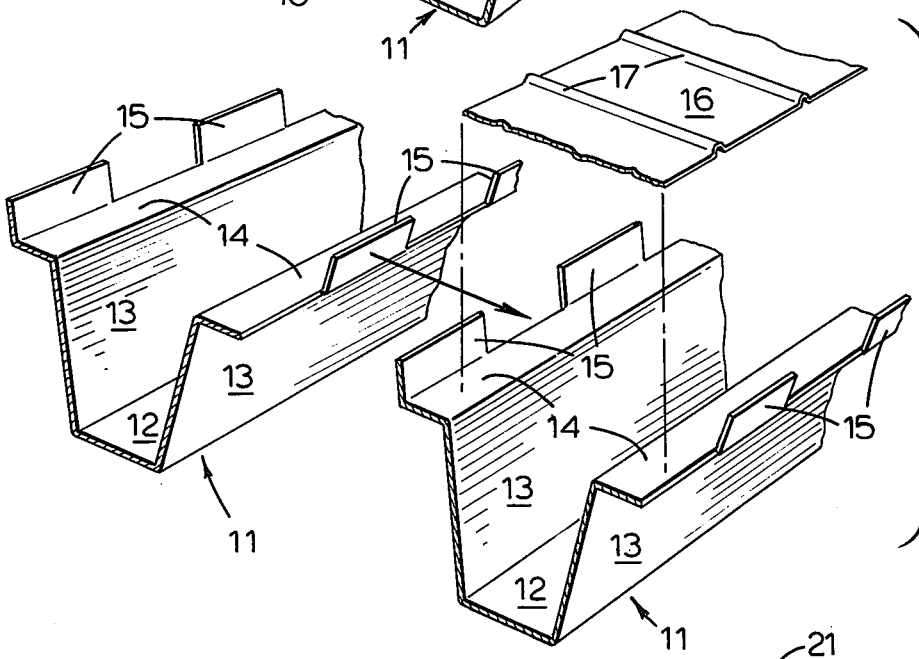
FIG. 2 is a perspective, exploded view of certain of the elements shown in FIG. 1.
Figure 3:
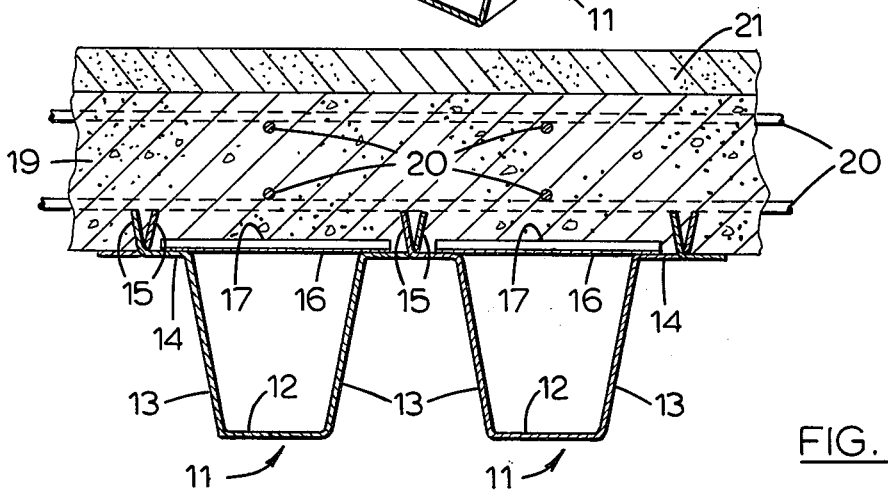
FIG. 3 is a transversely sectioned view of the composite structural assembly shown in FIG. 1.

Referring to the drawings and with particular reference to FIGS. 1, 2 and 3 thereof, 10 denotes generally support means which comprises a plurality of support members 11 disposed in side-by-side relationship, each of these support members 11 being of generally channel form in transverse cross-section and comprising a lower web portion 12, two upwardly divergent limb portions 13, and two flange portions 14 which project outwardly from the upper longitudinally extending edges of the limb portions 13 remote from the web portion 12. The side edge portions of each support member 11 constituted by the flange portions 14 thereof each presents spaced, projecting lugs 15, with the lugs 15 presented by the opposed side edge portions of each support member 11 being upwardly divergent, i.e. being divergent in the direction from the flange portions 14 away from the web portion 12. The lugs 15 presented by one of adjacent side edge portions of adjacent support members 11 alternate in interfitted relationship with the lugs 15 presented by the other of said adjacent side edge portions of said adjacent support members 11, as is clearly shown in FIG. 1, so that the interfitted lugs 15 are inclined at an angle relative to one another as shown in, for example, FIG. 3.

A pan member 16 is mounted on each support member 11, the pan member 16 which is provided with a plurality of transversely disposed ribs 17 for strengthening purposes spanning the channel presented by the associated support member 11 with side edge portions of the pan member 16 being supported on the flange portions 14 of the support member 11. Preferably, said side edge portions of each pan member 16 are secured to the flange portions 14 of the associated support member 11 by, for example, spot welding 18.

A layer 19 of cementitious material such as concrete is disposed on the plurality of support members 11, this layer 19 being in contact with the pan members 16, and the lugs 15 being embedded within the layer 19 of cementitious material.

The above-described interfitting of the lugs 15 and the embedding of these lugs 15 in the layer 19 of cementitious material constitutes an extremely simple and yet efficient securement of the support means constituted by the support members 11 to the layer 19 of cementitious material, particularly since the lugs 15 are preferably each integral with the associated support member 11 so that the manufacture of the support members 11, and hence the production of the composite structural assembly as a whole, is relatively simple and inexpensive.

As is conventional in the art relating to structural concrete, reinforcement rods 20 which are preferably of steel or other suitable metallic material may be embedded within the layer 19 of cementitious material. Appropriate ones of these reinforcement rods 20 which are disposed substantially transverse to the lugs 15 may be disposed in supported contact with free edges, i.e. the upper edges of the appropriate lugs 15 as is shown in FIG. 3, so during the pouring of the layer 19 of cementitious material and during the setting of this layer 19 the appropriate lugs 15 serve to retain these reinforcement rods 20 in the desired positions.

A composite structural assembly according to the present invention is particularly adapted for use as a highway bridge, and where for example the assembly is intended to be so used a layer 21 of asphaltic material is preferably disposed on the face of the layer 19 of cementitious material remote from the support member 11, i.e on the upper face of the layer 19 of cementitious material. While as indicated above a composite structural assembly according to the present invention is particularly adapted to be used as a highway bridge it is to be understood that such a composite structural assembly may alternatively be used as, for example, flooring, and particularly long span flooring, in building structures.

The alternative embodiment of the invention shown in FIG. 4 differs from that hereinbefore described with reference to FIGS. 1 to 3 in that the interfitted lugs 15 have spaces 22 therebetween and the reinforcement rods 20 or appropriate ones of these reinforcement rods 20 are disposed through the spaces 22 between the interfitted lugs 15. These reinforcement rods 20 may either be in contact with the lugs 15, or they may be spaced from the interfitted lugs 15, as desired.

The further alternative embodiment of the invention shown in FIG. 5 differs from that hereinbefore described with reference to FIG. 4 in that end portions 23 of the lugs 15 are disposed in a deflected condition, so that each end portion 23 is at an angle to the remainder of the associated lug 15. This feature may be desirable in certain cases in order further to improve the securement between the support members 11 and the layer 19 of cementitious material.

The still further alternative embodiment of the invention shown in FIG. 6 differs from that hereinbefore described with reference to FIG. 4 in that the lugs 15 are not interfitted, and instead the lugs 15 presented by the opposed side edge portions of each support member 11 are convergent in the upward direction, i.e. in the direction from said support member 11 towards the face of the layer 19 of cementitious material remote from said member 11 adjacent lugs 15 presented by adjacent side edge portions of adjacent support members 11 thus again being inclined at an angle relative to one another. The spaces 24 between the lugs 15 presented by each side edge portion of each support member 11 are of relatively small longitudinal dimensions, and preferably correspond in dimensions substantially to the spaces 22, with these spaces 24 each being in alignment with respective ones of the spaces 24 between the lugs 15 presented by the other of the side portions of the support members 11. The reinforcement rods 20 or the appropriate ones of the reinforcement rods 20 are disposed through the spaces 24 and may again be in contact with the lugs 15, or may be spaced from the lugs 15 as desired.

Figure 6:
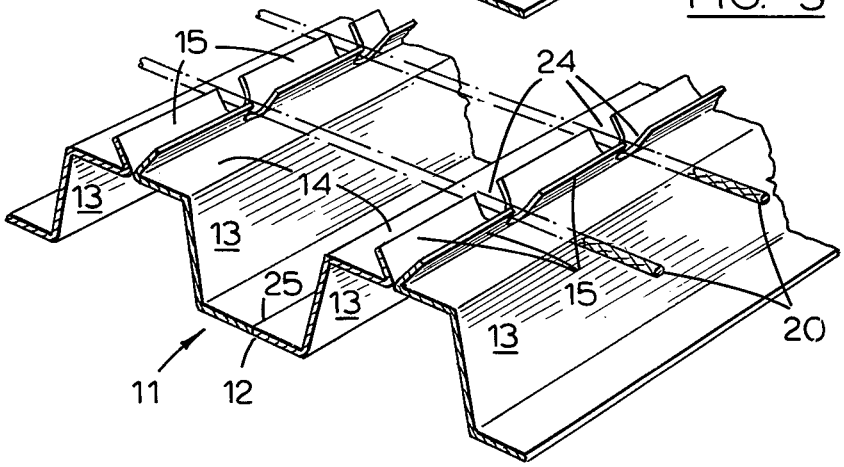

Furthermore, in this alternative embodiment of the invention shown in FIG. 6 the longitudinally extending edge portions of the adjacent flange portions 14 of adjacent support members 11 from which the appropriate lugs 15 project may, if desired, be securely interconnected as, for example, by welding.

Figure 4:
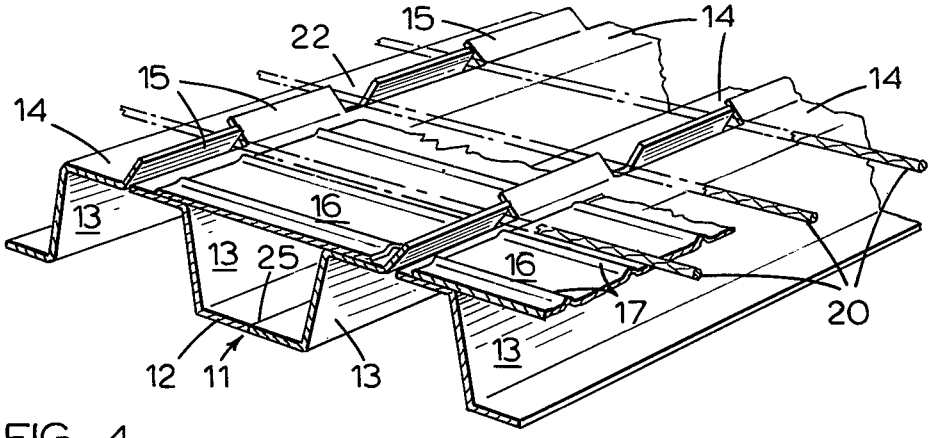
FIGS. 4, 5 and 6 are perspective views corresponding to FIG. 1 of composite structural assemblies according to alternative preferred embodiments of the invention, portions of the assemblies being omitted from these views for clarity.
Figure 5:
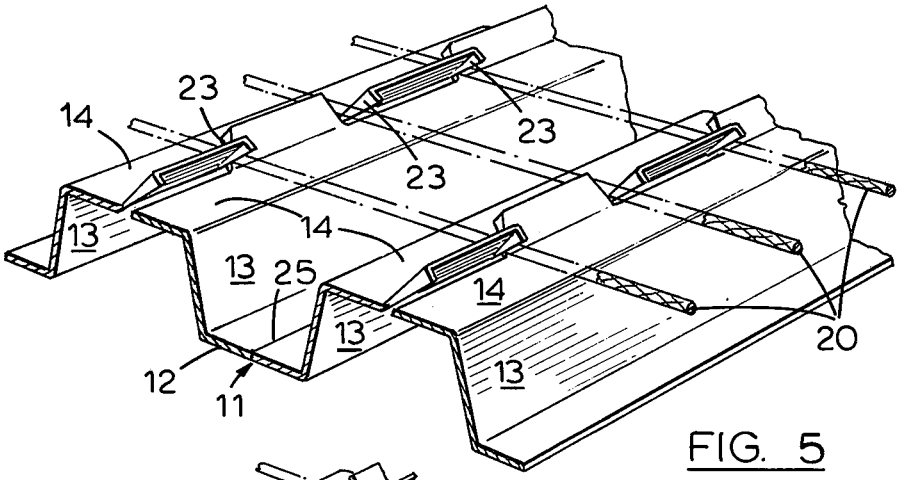

In the embodiments shown in FIGS. 4, 5 and 6 it will also be noted that each of the support members 11 is constituted by two parts with a joint 25 therebetween, this joint 25 extending longitudinally along the web portion 12 of the support member 11. It will of course be understood that in the embodiment hereinbefore described with reference to FIGS. 1, 2 and 3 each of the support members 11 may be similarly formed.

What I claim as my invention is:

1. A composite structural assembly comprising a plurality of support members disposed in side-by-side relationship, and a layer of cementitious material disposed on the plurality of support members, wherein the plurality of support members have side edge portions each of which presents spaced, projecting lugs, with the lugs presented by one of adjacent side edge portions of adjacent support members alternating in interfitted relationship with the lugs presented by the other of said adjacent side edge portions of said adjacent support members, and with the lugs being embedded within the layer of cementitious material.

2. A structural assembly according to claim 1, wherein the lugs presented by the opposed side edge portions of each support member are divergent in the direction from said member towards the face of the layer of cementitious material remote from said member whereby the interfitted lugs are inclined at an angle relative to one another.

3. A structural assembly according to claim 1 wherein reinforcement rods are embedded within the layer of cementitious material, the lugs having free edges with which said reinforcement rods are in supported contact, with said rods disposed substantially transverse to said lugs.

4. A structural assembly according to claim 1, wherein reinforcement rods are embedded within the layer of cementitious material, the interfitted lugs having spaces therebetween, with the reinforcement rods being disposed through said spaces between the interfitted lugs.

5. A structural assembly according to claim 1, wherein each said support member is of channel form in transverse cross-section.

6. A structural assembly according to claim 1, wherein each said support member is of channel form in transverse cross-section and a pan member is mounted on each support member, the pan member spanning the channel with side edge portions of the pan member supported on the side edge portions of said support member and with the layer of cementitious material in contact with the pan member.

7. A structural assembly according to claim 1, wherein end portions of the lugs are disposed in a deflected condition, with each said end portion being at an angle to the remainder of the associated lug.

8. A structural assembly according to claim 1, for use as a highway bridge, wherein a layer of asphaltic material is disposed on the face of the layer of cementitious material remote from the plurality of support members.

9. A composite structural assembly comprising a plurality of support members disposed in side-by-side relationship, and a layer of cementitious material disposed on the plurality of support members, wherein the plurality of support members have side edge portions each of which presents spaced, projecting lugs, with the lugs presented by the opposed side edge portions of each support member being convergent in the direction from said member towards the face of the layer of cementitious material remote from said member, whereby adjacent lugs presented by adjacent side edge portions of adjacent support members are inclined at an angle relative to one another, the spaces between the lugs presented by each of said side edge portions each being in alignment with respective ones of the spaces between the lugs presented by the other of said side edge portions, and reinforcment rods being disposed through said spaces, with the lugs and the reinforcement rods being embedded within the layer of cementitious material.

10. A structural assembly according to claim 9, wherein each said support member is of channel form in transverse cross-section.

11. A structural assembly according to claim 9, wherein each said support member is of channel form in transverse cross-section and a pan member is mounted on each support member, the pan member spanning the channel with side edge portions of the pan member supported on the side edge portions of said support member and with the layer of cementitious material in contact with the pan member.

12. A structural assembly according to claim 9, wherein end portions of the lugs are disposed in a deflected condition, with each said end portion being at an angle to the remainder of the associated lug.

* * * * *